United States Patent [19]

Crafts

[11] Patent Number: 4,805,238

[45] Date of Patent: Feb. 21, 1989

[54] MIXOLOGIST MITT

[76] Inventor: Cynthia S. Crafts, 340 NW. 42 Ct., #2, Pompano Beach, Fla. 33064

[21] Appl. No.: 136,777

[22] Filed: Dec. 21, 1987

[51] Int. Cl.[4] ..... A41D 19/00

[52] U.S. Cl. ..... 2/20; 2/161 A; 2/161 R

[58] Field of Search ..... 2/20, 161 R, 161 A

[56] References Cited

U.S. PATENT DOCUMENTS

| | | | |
|---|---|---|---|
| 3,049,717 | 8/1962 | Meyer | 2/161 A |
| 3,606,319 | 9/1971 | Borden | 2/161 A |
| 3,871,029 | 3/1975 | Hollman | 2/161 A |
| 4,556,215 | 12/1985 | Tarbox et al. | 2/161 A |
| 4,575,075 | 3/1986 | Tarbox et al. | 2/161 A |

*Primary Examiner*—Werner H. Schroeder
*Assistant Examiner*—Jeanette E. Chapman

[57] ABSTRACT

This mitt is designed to protect a mixologist from getting a callous in the palm of the hand when opening a great many bottles of beer in a busy bar. Primarily, it consists of a flexible body with ventilation openings, and the palm portion engages with the palm of the user for protection of the user's palm. Forward straps are provided for receiving the forefinger and the little finger of the hand of the user, and rear wrist straps are provided and include hook and loop pile fasteners for securing the mitt to the hand of the user.

3 Claims, 1 Drawing Sheet

FIG. 1
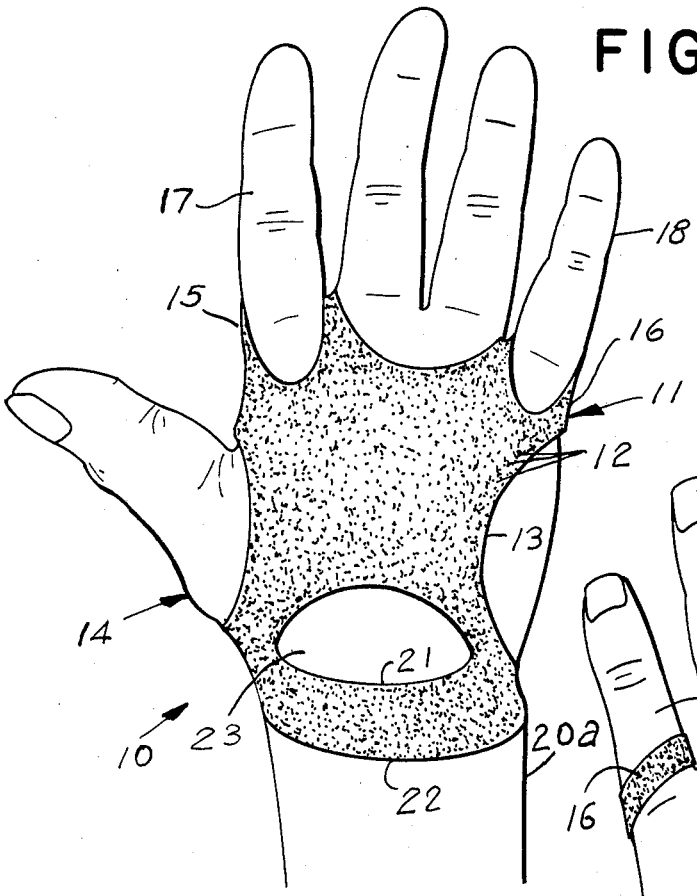
FIG. 2
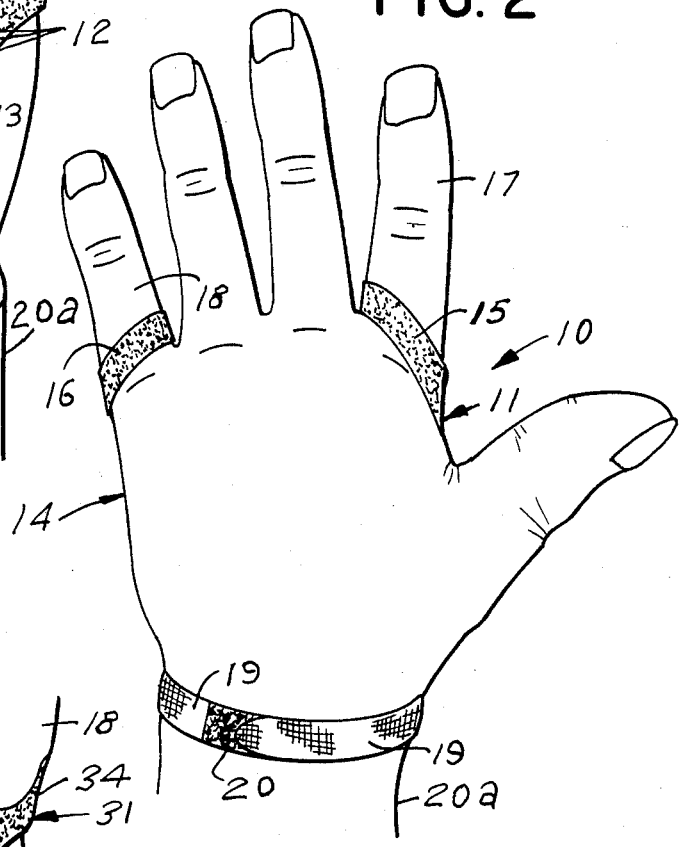
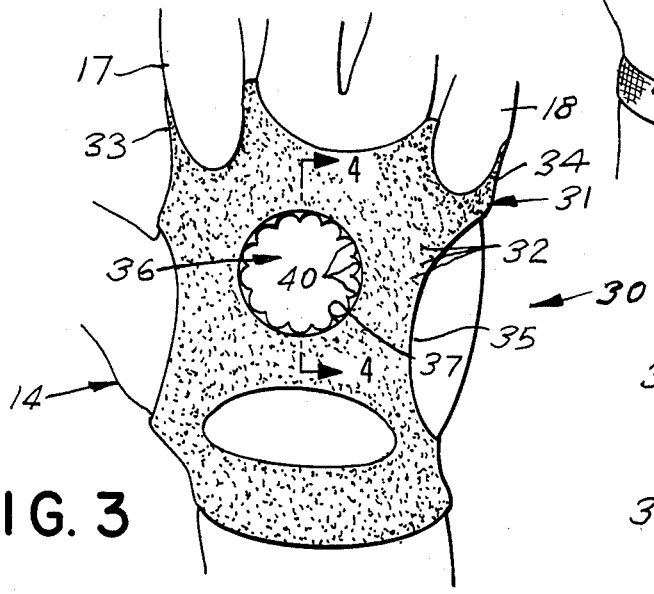
FIG. 3
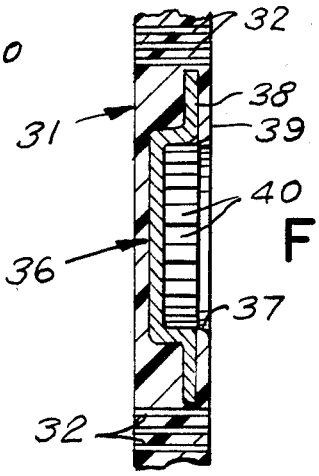
FIG. 4

MIXOLOGIST MITT

BACKGROUND OF THE INVENTION

1. Field of the Invention

This invention relates to hand protection devices, and more particulary, to a mixologist mitt.

2. Description of Prior Art

Devices for the hand have been provided in the prior art that are adapted to protect one's hand. For example, U.S. Pat. Nos. 4,531,241 of Berger, 4,371,984 of Fowler, 3,896,498 of Pang, and 3,812,741 of Heine, all are illustrative of the prior art. While these articles may be suitable for the purpose of the present invention.

The principal object of this invention is to provide a mixologist mitt that will be of such design, as to protect a bartender's hand from any further damage resulting from opening many beer bottles.

It has been well established that bartenders do not use bottle openers, because openers take too much time in busy bars, and if one works in a busy bar, most likely they will have a callous on their palm, therefore, the present invention is designed to prevent callous from forming and disfiguring the palm of the hand.

A further object of this invention is to provide a mixologist mitt that will be so designed, as to also be comfortable when worn.

A still further object of this invention is to provide a mixologist mitt that will be simple in design, inexpensive to manufacture, and easy to use.

SUMMARY OF THE INVENTION

A mixologist mitt, comprising a body portion with forward and continuous strap portions for reception of the forefinger and the little finger of the hand, and a palm portion engages with a user's hand and a bottle cap, for prevention of a callous forming on the palm of the user's hand. A wrist strap portion is also provided for fastening the mitt to the hand of the user.

BRIEF DESCRIPTION OF FIGURES

FIG. 1 is a bottom plan view of the present invention;

FIG. 2 is a top plan view of the invention;

FIG. 3 is a bottom view of a modified form of the invention, and

FIG. 4 is an enlarged cross-sectional view, taken along the line 4—4 of FIG. 3.

DETAILED DESCRIPTION

Accordingly, a mitt 10 is shown to include a body 11 fabricated of a suitable flexible waterproof material having a plurality of spaced openings 12 therethrough so as to enable ventilation, because a mixologist often puts their hands in water when washing glasses and the like. Body 11 includes a palm portion 13 that engages with the palm of the hand 14, and straps 15 and 16 are integrally attached to body 11 and are received on the forefinger 17 and the little finger 18 of hand 14. A pair of rear straps 19 are integrally attached to body 11, and hook and loop pile fasteners 20 (one of which is shown), are secured to straps 19 and fasten the straps 19 around the wrist 20*a*. An opening 21 through body 11 is adjacent to a wrist portion 22, and opening 21 exposes the heel portion of hand 14.

In use, the palm portion 13 is engaged with the cap of a beverage bottle (not shown), so as to remove the cap the wearer of mitt 10, through a twisting motion.

Referring now to FIGS. 3 and 4, a modified form of mitt 30 is shown to include a body 31 similar to body 11 of the embodiment of FIGS. 1 and 2, and openings 32 are provided through mitt 31 for ventilation. Forward straps 33 and 34 are integrally attached to body 31 for reception of the forefinger 17 and the little finger 18 of hand 14.

The rear portion of body 31 is similar to that described of body 11 of mitt 10, however, the palm portion 35 includes a female receptacle 36 that is molded into palm portion 35 at an opening 37. Receptable 36 includes an integrally attached flange 38 that is held secure by an annular portion 39 integrally attached to palm portion 35. A plurality of annular and equally spaced recess 40 forming teeth, are provided on the interior of receptacle 36, for engagement with a bottle cap (not shown) for its removal from a bottle.

In use, mitt 20 is employed in the same manner described of mitt 10, with the exception, that the receptacle 36 is used to engage with and remove a bottle cap.

While various changes may be made in the detailed construction, such changes will be within the spirit and scope of the present invention, as defined by the appended claims.

I claim:

1. A mixologist mitt comprising, a flexible body portion, having a palm portion for engagement with a beverage bottle cap to be twisted off, said palm portion covering the entire palm of the hand, and a female receptacle molded into the center of the palm portion to protect the palm of the hand.

2. The mixologist mitt of claim 1 wherein said receptacle has teeth on its interior surface.

3. The mixologist mitt of claim 1 being made of waterproof, flexible, ventilated material with a multiplicity of a spaced openings.

* * * * *